US007278798B1

(12) United States Patent
Kearney

(10) Patent No.: US 7,278,798 B1
(45) Date of Patent: Oct. 9, 2007

(54) WIPER FOR COSMETICS BOTTLE

(75) Inventor: Thomas Kearney, Summit, NJ (US)

(73) Assignee: Risdon International, Inc., Watertown, CT (US)

( * ) Notice: Subject to any disclaimer, the term of this patent is extended or adjusted under 35 U.S.C. 154(b) by 0 days.

(21) Appl. No.: 11/455,048

(22) Filed: Jun. 16, 2006

(51) Int. Cl.
*A46B 11/00* (2006.01)

(52) U.S. Cl. ..... 401/129; 401/122; 401/121

(58) Field of Classification Search ..... 401/118, 401/121, 122, 126–130; 132/317
See application file for complete search history.

(56) References Cited

U.S. PATENT DOCUMENTS

| | | | | |
|---|---|---|---|---|
| 3,214,782 | A | 11/1965 | Masters et al. | 401/122 |
| 3,363,635 | A | 1/1968 | Wurmböck | 132/218 |
| 4,411,282 | A | 10/1983 | Wavering | 132/88.5 |
| 4,437,477 | A | 3/1984 | Gueret | 132/88.5 |
| 4,503,872 | A | 3/1985 | Guéret | 132/88.5 |
| 4,572,224 | A | 2/1986 | Rosenwinkel et al. | 132/88.5 |
| 4,796,647 | A | 1/1989 | Gueret | 132/320 |
| 4,946,302 | A | 8/1990 | Uchida | 401/288 |
| 4,974,980 | A | 12/1990 | Gueret | 401/119 |
| 5,097,853 | A | 3/1992 | Nehashi | 132/320 |
| 5,226,744 | A | 7/1993 | Kemmerer | 401/4 |
| 5,597,254 | A | 1/1997 | Vasas | 401/122 |
| 5,599,125 | A | 2/1997 | Vasas et al. | 401/122 |
| 5,720,563 | A | 2/1998 | Nakagawa | 401/119 |
| 5,873,669 | A * | 2/1999 | Poore et al. | 401/122 |
| 5,899,622 | A | 5/1999 | Gueret | 401/122 |
| 5,951,185 | A | 9/1999 | Kingsford et al. | 401/99 |
| 6,010,266 | A | 1/2000 | Schrepf | 401/126 |
| 6,033,142 | A | 3/2000 | Gueret | 401/122 |
| 6,231,256 | B1 | 5/2001 | Kingsford et al. | 401/108 |
| 6,305,385 | B1 | 10/2001 | Szekely | 132/218 |
| 6,799,582 | B2 | 10/2004 | Kim | 132/317 |
| 2005/0115011 | A1 | 6/2005 | Petit | 15/191.1 |
| 2005/0220528 | A1 | 10/2005 | Petit | 401/122 |

FOREIGN PATENT DOCUMENTS

| | | |
|---|---|---|
| EP | 0 740 912 | 11/1996 |
| FR | 2 868 268 | 4/2004 |

* cited by examiner

*Primary Examiner*—David J. Walczak
(74) *Attorney, Agent, or Firm*—St. Onge Steward Johnston & Reens LLC

(57) ABSTRACT

A wiper for use in a cosmetics bottle fabricated from a semi-rigid plastic such as low density polyethylene. The wipe has a sleeve with an integral wiper diaphragm defining an orifice having a wiper edge. The wiper diaphragm is connected to the sleeve by a plurality of spaced-apart ribs which act to hold any pieces of the diaphragm which may break off in use, and prevent them from falling into the cosmetics bottle and any product contained in the bottle.

18 Claims, 3 Drawing Sheets

WIPER FOR COSMETICS BOTTLE

FIELD OF THE INVENTION

The present invention relates to packaging for fluid products, especially fluid cosmetic products such as mascaras, foundation, liquid rouge, eyeliners, eyeshadow, lip tint, and lip gloss.

BACKGROUND OF THE INVENTION

Mascara and other liquid cosmetics are typically packaged in a bottle having a removable cap and applicator. The applicator is usually mounted to the end of a rod, which is in turn mounted to the inside of the cap. In mascara applications, the applicator is typically a twisted wire brush containing bristles. In other cosmetic applications the applicator may be a cosmetic foam sponge or a felt tip or other absorbent or porous material having a load carrying capacity. The cap is typically threaded and can be screwed onto the neck of the bottle to close the bottle. When the bottle is closed, the rod extends down from the cap through the neck and a wiper element and into the bottle. The cosmetic bulk product, such as mascara, is located in the bottle and the applicator is positioned within the bulk product when the cap is closed. To use the applicator, the consumer will typically unscrew that cap from the bottle and pull the rod and applicator from the bottle. As the rod is withdrawn, it is wiped by the wiper element to remove the bulk product from the rod. The wiper element then wipes the applicator to reduce excess bulk product so that the applicator is loaded with a desirable amount of bulk product which is not too much, and not too little.

Many wiper designs have been developed and used in the past. Typically, the wiper is fabricated of buna rubber or neoprene, which are highly resilient and flexible materials that are both effective and do not degrade during the period of use. However, the material costs and cost of fabrication for wipers made of such materials are relatively high. In addition, wipers fabricated from such materials are not self-seating in the bottle neck, and instead are fabricated as a diaphragm which must be held in place with a separate neck insert, with the diaphragm positioned between insert and the bottle neck.

Wipers have been fabricated from low density polyethylene ("LDPE"), which is a less expensive material to use both in terms of materials cost and fabrication cost. LDPE wipers are relatively rigid and thus provide a poorer seal absent a very thin wiper edge. However, a thin wiper edge is susceptible of a significant potential problem, namely that the rigid wiper edge of the wiper diaphragm will crack and fail through repeated use, causing small bits of broken LDPE wiper to become mixed into the cosmetics bulk product.

SUMMARY OF THE INVENTION

It is a principal object of the invention herein to provide a cosmetics container including an efficient wiper.

It is an additional object of the invention to provide a wiper for a cosmetics container which achieves a good seal with the applicator rod.

It is a further object of the invention herein to provide a wiper for a cosmetics container with good control of the amount of cosmetics carried by the applicator.

It is yet another object of the invention to provide a wiper for a cosmetics container which is low in cost.

The present invention provides a wiper element for a cosmetics bottle which provides substantial cost savings by allowing use of lower cost materials, preferably semi-rigid plastics such as LDPE, and does not require a separate part such as a neck insert to hold the wiper in place. The wiper further solves problems of potential cracking and shattering of the wiper edge. The wiper permits lower cost manufacturing of mascara brushes with smaller diameter mascara brushes as it allows use of stock size rods instead of custom manufactured rods in such applications. This is accomplished because the wiper is adapted to wipe a smaller diameter mascara brush mounted on a standard size rod.

In accordance with one embodiment of the invention, a wiper for use in a cosmetics bottle having a neck and an applicator rod and applicator comprises a sleeve, fabricated from a semi-rigid plastic, having an inner wall and a outer wall, which is tightly fittable in the cosmetics bottle neck. The sleeve has an integral wiper diaphragm extending radially inwardly from its inner walls. The wiper diaphragm has an orifice having a wiper edge. The diaphragm is a downwardly and inwardly extending curved surface terminating in the wiper orifice. The wiper diaphragm is connected to the sleeve by a plurality of spaced-apart ribs which hold any pieces of the diaphragm which might break off in use, and prevent them from falling into the cosmetics product.

Other features and objects of the invention will appear in the following description of the preferred embodiments and the claims, taken in connection with the accompanying drawings.

DETAILED DESCRIPTION OF THE INVENTION

Figure 2:
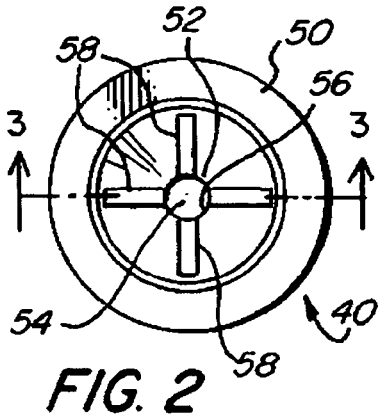
FIG. 2 is a top plan view of a wiper for a cosmetics bottle in accordance with one embodiment of the invention.
Figure 3:
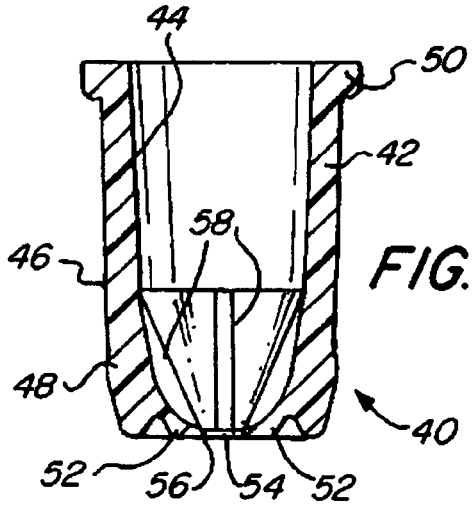
FIG. 3 is a front cross-sectional view of the wiper for a cosmetics bottle of FIG. 2 along the line 3-3.
Figure 4:
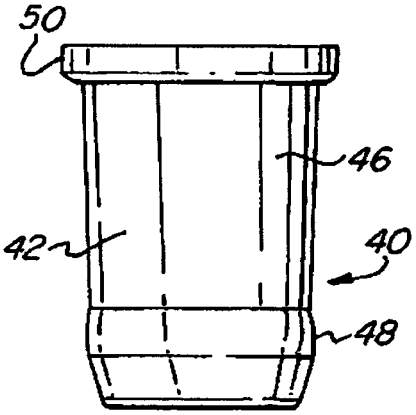
FIG. 4 is a front elevation view of the wiper for a cosmetics bottle of FIG. 2.
Figure 1:
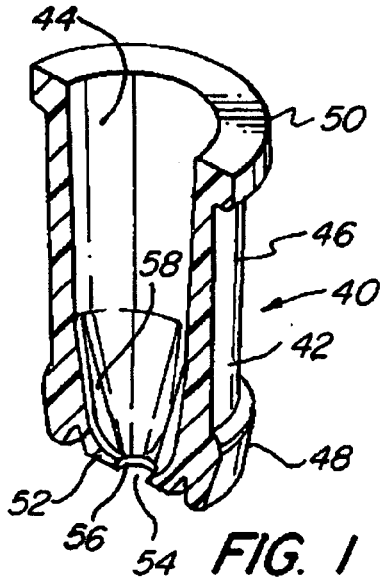
FIG. 1 is a perspective view in cross-section of a wiper for a cosmetics bottle in accordance with one embodiment of the invention.
Figure 5:
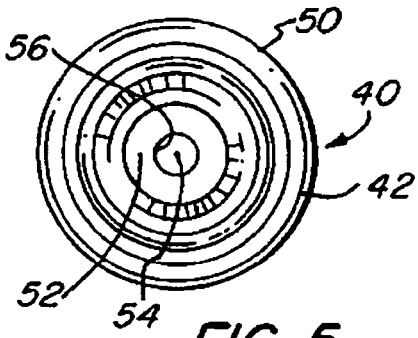
FIG. 5 is a bottom plan view of the wiper for a cosmetics bottle of FIG. 2.
Figure 6:
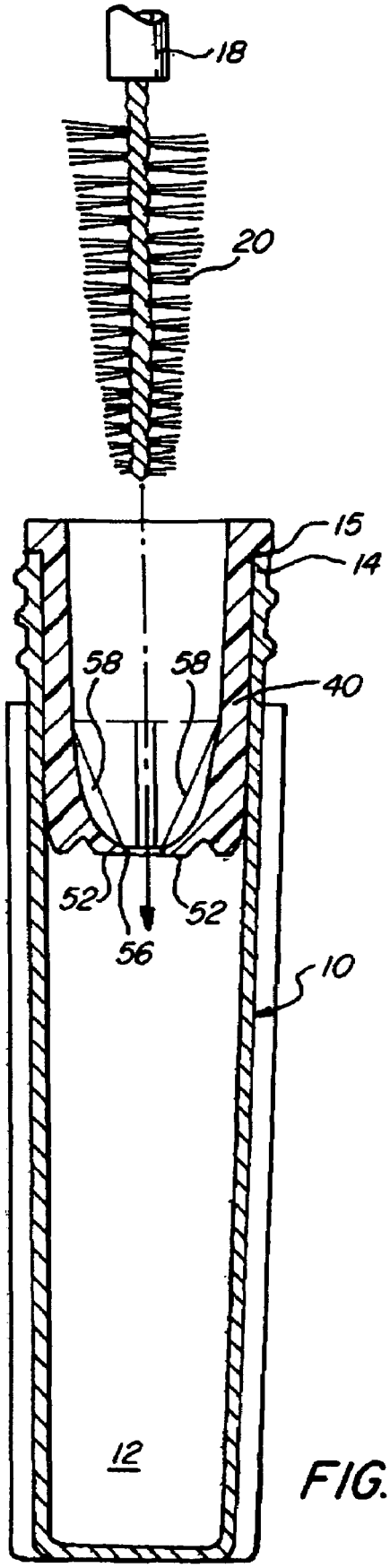
FIG. 6 is a front cross-sectional view of the wiper for a cosmetics bottle of FIG. 2 installed in a cosmetics bottle with a mascara rod and brush assembly positioned to be inserted into the wiper and into the bottle.

Referring now to FIGS. 1-8, a wiper 40 in accordance with the invention is shown. As seen particularly in FIGS. 6-8, wiper 40 is intended for use in a cosmetics bottle 10 having a chamber 12 for containing cosmetics and a neck 14. Bottle 10 has a cap 16 removably secured to the neck 14. Typically, neck 14 is externally threaded and cap 16 has mating internal threads in its inner surface so that cap 16 can be screwed onto neck 14. Cap 16 has an applicator rod 18 affixed to and extending downwardly from cap 16. Rod 18 extends downwardly through the neck 14 into the chamber 12. Rod 18 has a rod diameter. Rod 18 has an applicator 20 mounted to its distal end for carrying cosmetics from the chamber 12 upon removal of the cap 16, applicator rod 18 and applicator 20 from the bottle. Applicator 20 has a maximum applicator diameter. Applicator 20 may comprise a mascara brush, and in particular may comprise a twisted wire brush containing bristles. Alternatively, the applicator may comprise a cosmetic foam sponge or a felt tip or other absorbent or porous material having a load carrying capacity. The particular applicator will be selected depending on the specific cosmetic material provided in the chamber 12.

As seen particularly in FIGS. 1-5, wiper 40 is fabricated from a semi-rigid plastic, preferably LDPE. Wiper 40 is formed of a sleeve 42 having an inner wall 44 and a outer wall 46. The outer wall 46 of sleeve 42 fits tightly into neck 14 and retained in place by friction fit. Outer wall 46 has a rim 48 around its lower end that has a slightly larger diameter for insuring a tight sealing fit in neck 14. Sleeve 42 has a radial lip 50 extending outwardly from an upper end thereof for seating on the upper edge 15 of neck 14.

Sleeve 42 has an integrally molded wiper diaphragm 52 extending radially inwardly from inner wall 44 of sleeve 42 at a lower end thereof. Wiper diaphragm 52 has an orifice 54 having a wiper edge 56. The wiper diaphragm tapers in thickness from a thicker first end adjacent the sleeve to the wiper edge, which is thinner than the thicker first end. Wiper diaphragm 52 is formed as a downwardly and inwardly extending curved surface terminating in wiper orifice 54. Wiper diaphragm 52 is connected to sleeve 42 by a plurality of spaced-apart ribs 58. Ribs 58 extend at an angle upwardly and outwardly from wiper edge 56 of the wiper diaphragm 52 to the inner wall 44 of the sleeve 42. Ribs 58 hold any pieces of the diaphragm which may break off in use, and prevent them from falling into the cosmetics product.

Figure 7:
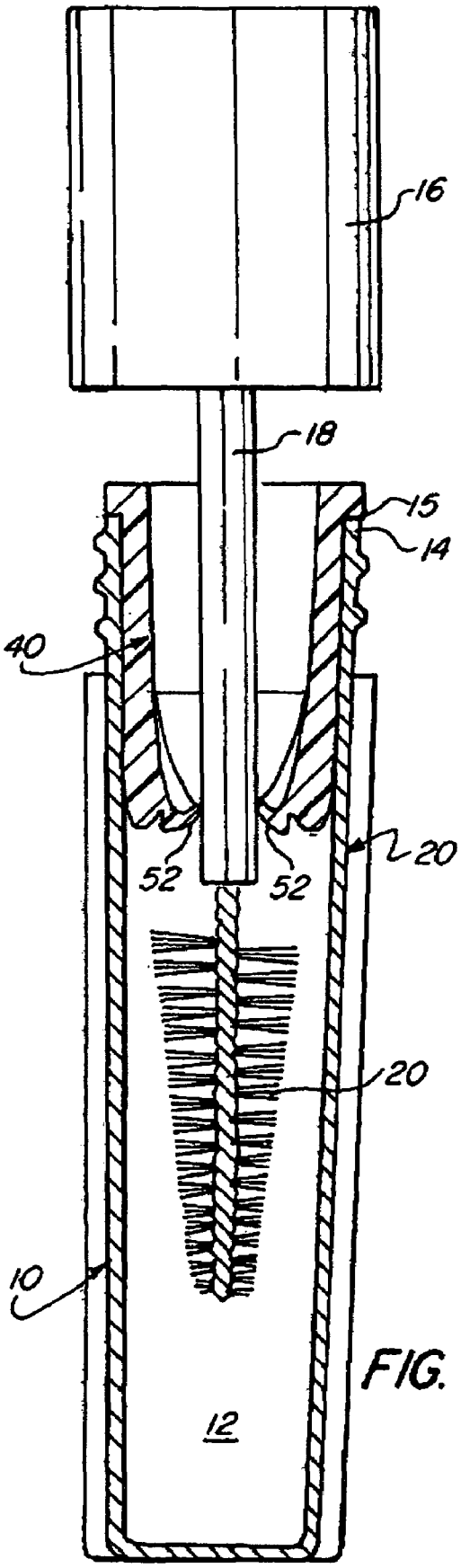
FIG. 7 is a front cross-sectional view of the assembly of FIG. 6 with the mascara rod passing through said wiper as the mascara rod and brush assembly is drawn out through the wiper and the bottle.
Figure 8:
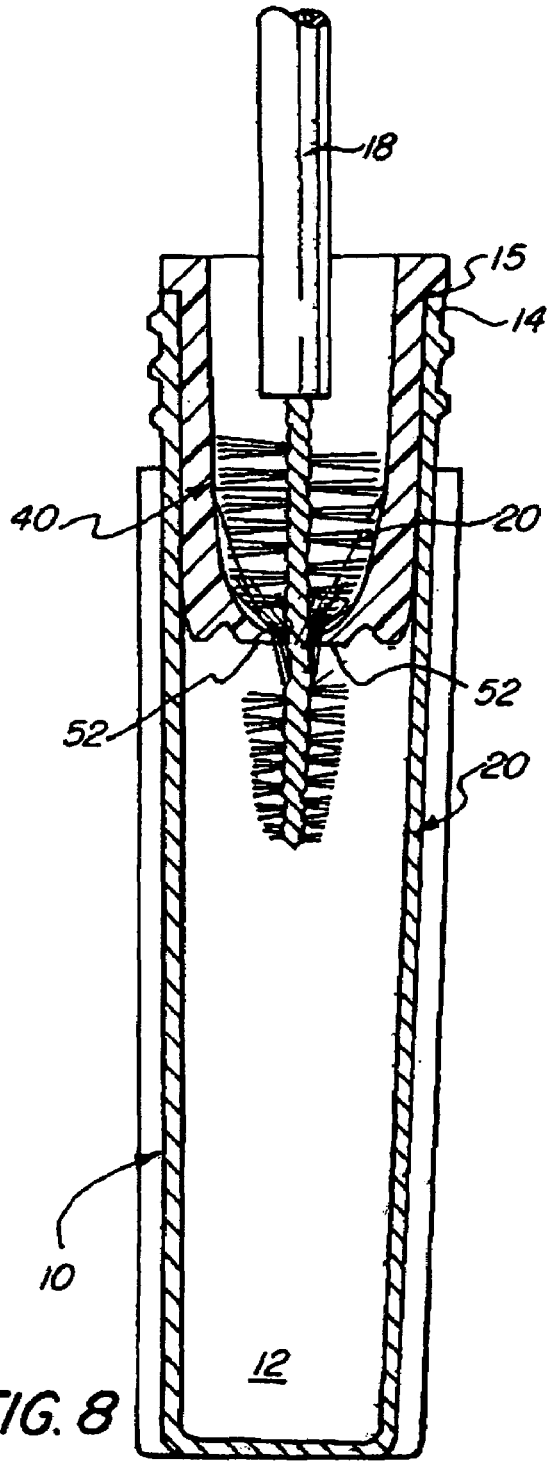
FIG. 8 is a front cross-sectional view of the assembly of FIG. 6 with the mascara brush assembly passing through said wiper as the mascara rod and brush assembly is drawn out through the wiper and the bottle.

Wiper orifice 54 has an orifice diameter which is less than the diameter of rod 18, and less than the maximum diameter of the applicator 20. As best seen in FIG. 7, wiper edge 56 has a sufficiently small thickness such that wiper diaphragm 52 resiliently deforms to seal around the applicator rod 18 and wipes the applicator rod 18 when it is withdrawn from the bottle. Further, as seen in FIG. 8, the wiper diaphragm 52 resiliently deforms to wipe applicator 20 when it is withdrawn from the bottle. Preferably, wiper edge 56 has a thickness of about 0.015 inches or less, most preferably, about 0.008 inches or less.

The present invention provides a substantial cost savings by allowing use of lower cost materials, preferably semi-rigid plastics such as LDPE, and does not require a separate part such as a neck insert to hold the wiper in place. The wiper further solves problems of potential cracking and shattering of the wiper edge. The wiper permits lower cost manufacturing of mascara brushes with smaller diameter mascara brushes as it allows use of stock size rods instead of custom manufactured rods in such applications because the wiper has a sufficient resilience and flexibility to wipe a relatively large diameter rod and a relatively small diameter applicator even though the wiper is fabricated from LDPE.

While this invention has been particularly shown and described with reference to preferred embodiments thereof, it will be understood by those skilled in the art that various changes and modifications in form and details may be made thereto without departing from the spirit and scope of the invention as defined by the appended claims.

What is claimed is:

1. A wiper for use in a cosmetics bottle having a neck and an applicator rod and applicator, the wiper removing excess cosmetics from the applicator rod and applicator as they are withdrawn through the neck of the container, the wiper comprising:

an low density polyethylene sleeve having an inner wall and a outer wall, said outer wall of said sleeve being tightly fittable in the cosmetics bottle neck, said sleeve having an integral wiper diaphragm extending radially inwardly from said inner wall of said sleeve at a lower end thereof, said wiper diaphragm being formed as a downwardly and inwardly extending curved surface terminating in a wiper edge defining a wiper orifice, said wiper diaphragm being connected to said sleeve by a plurality of spaced-apart ribs extending at an angle upwardly and outwardly from said wiper edge of said wiper diaphragm to said inner wall of said sleeve, said wiper edge having a thickness of about 0.015 inches or less.

2. The wiper of claim 1, wherein said sleeve has a radial lip extending outwardly from an upper end thereof.

3. The wiper of claim 1, said wiper edge having a thickness of about 0.008 inches or less.

4. A wiper for use in a cosmetics bottle having a neck and an applicator rod and applicator, the wiper removing excess cosmetics from the applicator rod and applicator as they are withdrawn through the neck of the container, the wiper comprising:

a sleeve, fabricated from a semi-rigid plastic, having an inner wall and a outer wall, said outer wall of said sleeve being tightly fittable in the cosmetics bottle neck, said sleeve having an integral wiper diaphragm extending radially inwardly from said inner wall of said sleeve at a lower end thereof, said wiper diaphragm having an orifice having a wiper edge, said diaphragm being formed as a downwardly and inwardly extending curved surface terminating in said wiper orifice, said wiper diaphragm being connected to said sleeve by a plurality of spaced-apart ribs.

5. The wiper of claim 4, said wiper diaphragm tapering in thickness from a thicker first end adjacent said sleeve to said wiper edge which is thinner than said thicker first end.

6. The wiper of claim 4, said ribs extending upwardly and outwardly from said wiper diaphragm to said inner wall of said sleeve.

7. The wiper of claim 4, wherein said sleeve has a radial lip extending outwardly from an upper end thereof.

8. The wiper of claim 4, said wiper edge having a thickness of about 0.015 inches or less.

9. The wiper of claim 8, said wiper edge having a thickness of about 0.008 inches or less.

10. A cosmetics container assembly comprising:

a bottle having a chamber for containing cosmetics, the bottle having a neck;

a cap removably secured to the neck, the cap having an applicator rod, having a rod diameter, for extending through the neck into the chamber, and an applicator, having a maximum applicator diameter, at the distal end of the rod for carrying cosmetics from the chamber upon removal of the cap, applicator rod and applicator from the bottle;

a sleeve fabricated from a semi-rigid plastic, said sleeve having an inner wall and a outer wall, said outer wall of said sleeve being tightly fittable in said bottle neck, said sleeve having an integral wiper diaphragm extending radially inwardly from said inner wall of said sleeve at a lower end thereof, said wiper diaphragm having an orifice having a wiper edge, said diaphragm being formed as a downwardly and inwardly extending curved surface terminating in said wiper orifice, said wiper diaphragm being connected to said sleeve by a plurality of spaced-apart ribs, said wiper orifice having an orifice diameter, said orifice diameter being less than said rod diameter and less than said maximum applicator diameter, said wiper edge having a thickness such that said wiper diaphragm resiliently deforms to seal around said applicator rod and said wiper edge wipes said applicator rod when it is withdrawn from the bottle, and further said wiper diaphragm resiliently deforms to wipe said applicator when it is withdrawn from the bottle.

11. The cosmetics container assembly of claim 10, said wiper diaphragm tapering in thickness from a thicker first end adjacent said sleeve to said wipe edge which is thinner than said thicker first end.

12. The cosmetics container assembly of claim 10, said ribs extending upwardly and outwardly from said wiper diaphragm to said inner wall of said sleeve.

13. The cosmetics container assembly of claim 10, wherein said sleeve has a radial lip extending outwardly from an upper end thereof.

14. The cosmetics container assembly of claim 10, said wiper edge having a thickness of about 0.015 inches or less.

15. The cosmetics container assembly of claim 14, said wiper edge having a thickness of about 0.008 inches or less.

16. A cosmetics container assembly comprising:

a bottle having a chamber for containing cosmetics, the bottle having a neck;

a cap removably secured to the neck, the cap having an applicator rod, having a rod diameter, for extending through the neck into the chamber, and an applicator, having a maximum applicator diameter, at the distal end of the rod for carrying cosmetics from the chamber upon removal of the cap, applicator rod and applicator from the bottle;

a sleeve fabricated from low density polyethylene, said sleeve having an inner wall and a outer wall, said outer wall of said sleeve being tightly fittable in said bottle neck, said sleeve having an integral wiper diaphragm extending radially inwardly from said inner wall of said sleeve at a lower end thereof, said wiper diaphragm having an orifice having a wiper edge having a thickness of about 0.015 inches or less, said diaphragm being formed as a downwardly and inwardly extending curved surface terminating in said wiper orifice, said wiper diaphragm being connected to said sleeve by a plurality of spaced-apart ribs, said ribs extending at an angle upwardly and outwardly from said wiper edge of said wiper diaphragm to said inner wall of said sleeve, said wiper orifice having an orifice diameter, said orifice diameter being less than said rod diameter and less than said maximum applicator diameter, said wiper edge having a thickness such that said wiper diaphragm resiliently deforms to seal around said applicator rod and said wiper edge wipes said applicator rod when it is withdrawn from the bottle, and further said wiper diaphragm resiliently deforms to wipe said applicator when it is withdrawn from the bottle.

17. The cosmetics container assembly of claim 16, said wiper edge having a thickness of about 0.008 inches or less.

18. The cosmetics container assembly of claim 16, wherein said sleeve has a radial lip extending outwardly from an upper end thereof.

* * * * *